US005449538A

United States Patent [19]

Denny

[11] Patent Number: 5,449,538

[45] Date of Patent: Sep. 12, 1995

[54] LABEL/LEAFLET ASSEMBLIES

[75] Inventor: Barry D. Denny, Bury St. Edmunds, United Kingdom

[73] Assignee: Denny Bros Printing Limited, United Kingdom

[21] Appl. No.: 996,054

[22] Filed: Dec. 23, 1992

[30] Foreign Application Priority Data

Dec. 23, 1991 [GB] United Kingdom ..... 9127234

[51] Int. Cl.[6] ..... G09F 3/02; G09F 3/10

[52] U.S. Cl. ..... 428/40; 281/2; 281/5; 283/81; 428/42; 428/43; 428/124; 428/136; 428/137; 428/138; 428/194; 462/62; 462/63

[58] Field of Search ..... 428/40, 43, 42, 194, 428/124, 136, 137, 138; 462/62, 63; 281/2, 5; 283/81

[56] References Cited

U.S. PATENT DOCUMENTS 4,711,686 12/1987 Instance ..... 281/2
4,744,161 5/1988 Instance ..... 428/124
4,744,591 5/1988 Instance ..... 281/5

FOREIGN PATENT DOCUMENTS 0180365 5/1986 European Pat. Off. .
2213428 8/1987 United Kingdom .
WO8802308 4/1988 WIPO .

*Primary Examiner*—Nasser Ahmad
*Attorney, Agent, or Firm*—Michael D. Bednarek; Marks & Murase

[57] ABSTRACT

A label/leaflet assembly includes a support web with a release coating on which is placed an adhesive label with a leaflet secured on its front face. The leaflet has a front cover one end of which extends beyond the underlying panels of the leaflets. This end of the leaflet has a first part which is permanently joined to the main body of the front cover and which is releasably and re-sealably adherent to the label, and a second part which is permanently secured by an adhesive to the label and is connected to the first part and/or the main body of the front cover along one or more tear lines. Until opened the leaflet is held firmly sealed by the second part. When opened the leaflet is re-sealable, but the torn tear lines show that the leaflet has been opened. The assembly is thus tamper-evident.

13 Claims, 2 Drawing Sheets

LABEL/LEAFLET ASSEMBLIES

BACKGROUND OF THE INVENTION

This invention relates to label/leaflet assemblies and in preferred embodiments provides access to a leaflet on the label, permits the leaflet to be re-sealed on the label and provides visible indication if the leaflet has been opened.

SUMMARY OF THE INVENTION

According to this invention there is provided a label/leaflet assembly comprising a carrier web having a release coating on its front face, a label sheet having on its rear face an adhesive by which the label sheet is attached to the front face of the carrier web, a leaflet which is secured to the front face of the label sheet and which has a front cover sheet having a main body part overlying other sheets of the leaflet and an end portion extending beyond said other sheets, one or more areas of the end portion of the cover sheet being adhesively secured to the label sheet and being connected to adjoining parts of the end edge portion by a tear line or lines, the parts of the said end edge portion other than said area or areas being releasably and re-attachably attached to the label sheet, the arrangement being such that when said end portion is torn along the tear line or lines, said one or more areas remain adhesively secured to the label sheet and the other parts of the edge portion remain connected to the main body part of the cover sheet.

According to a preferred feature of the invention an adhesive is applied to the front face of the label sheet for releasably and re-attachably attaching said parts of the edge portion to the label sheet and for adhesively securing said one or more areas to the label sheet, said parts of the edge portion having thereon a coating which renders them releasably and re-attachably attached to the label sheet by the adhesive on the front face of the label sheet.

According to another preferred feature of the invention said area or areas comprise one or both of two corner parts at opposite transverse ends of said end portion of the cover sheet. In one such construction in which the two corner parts constitute said areas, a part of the end portion between said corner portions has its end edge extending beyond said corner portions and unattached to the label sheet so as to provide a tongue or tab capable of being gripped by the fingers.

Preferably said corner part or each of the corner parts is defined by a slit extending to a lateral edge of the cover sheet from a location adjacent such edge and by a tear line as aforesaid which extends from the inner end of the slit to the end edge of the cover sheet.

BRIEF DESCRIPTION OF THE DRAWINGS

The invention will now be described in more detail with reference by way of example to the accompanying diagrammatic drawings in which.

DETAILED DESCRIPTION OF THE PREFERRED EMBODIMENTS

Figure 1:
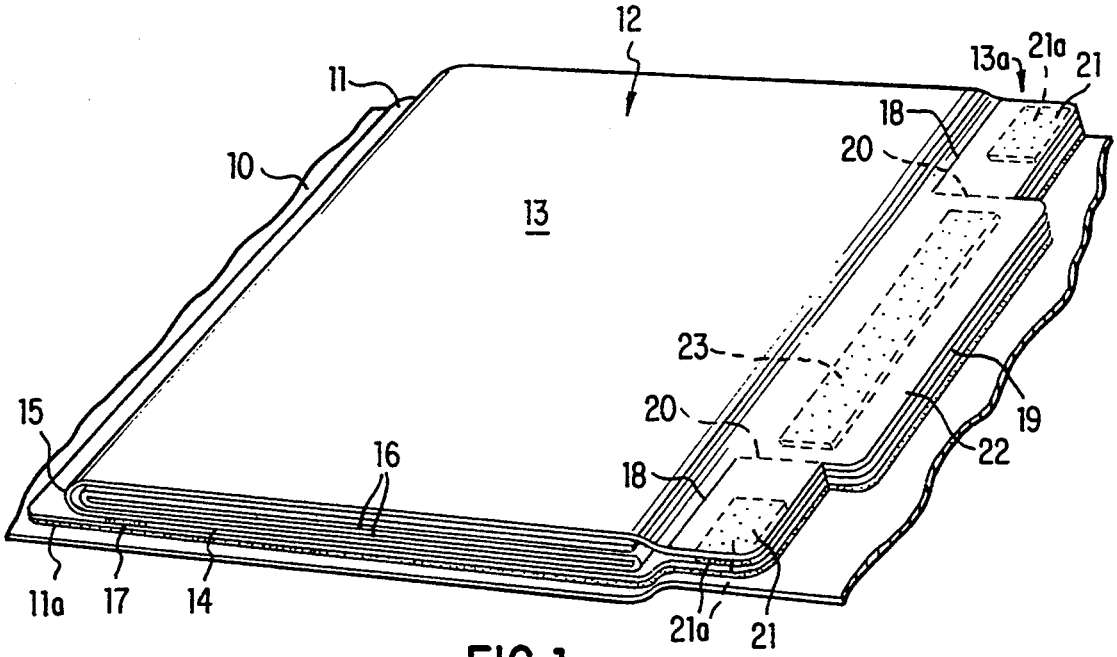
FIG. 1 shows a perspective view of a label/leaflet according to the invention, FIGS. 2 and 3 respectively show plan and elevation views of a second embodiment of the invention, and FIGS. 4 and 5 respectively show plan and elevation views of a third embodiment of the invention.

Each of the illustrated constructions comprises a carrier or support web 10 the front or upper surface of which is coated with a release material, a label sheet 11 having its rear face coated with an adhesive 11*a* by which the label sheet is releasably attached to the carrier web, and a leaflet 12 secured to the front face of the label sheet. The leaflet comprises a front cover sheet 13, a rear panel 14 connected to the cover sheet along a fold line 15, and one or more further panels 16 connected to the rear panel and to each other along fold lines, so that the further panels are disposed between the cover sheet and the rear panel. The rear panel is secured to the front face of the label sheet by a transverse line of adhesive 17 adjacent the fold line 15.

Referring now particularly to FIG. 1, the transverse end edge portion 13*a* of the cover sheet 13 remote from the fold line 15 extends beyond the folded sheets of the leaflet and beyond the folded sheets has two slits 18 extending parallel to the end edge 19 of the cover sheet to the respective adjacent lateral edges of the cover sheet from locations adjacent the lateral edges. A tear line 20 extends from the inner end of each slit 18 to the end edge 19 of the cover sheet and may be constituted by a broken line of cuts or slits. The two corner areas 21 of the cover sheet defined by the slits and the tear lines are secured to the underlying label sheet 11 by patches 21*a* of adhesive applied to the front face of the label sheet 11. The end portion 22 between the two corner areas 21 extends a short distance beyond these areas and is detachably and re-attachably attached to the label sheet by a line of adhesive 23 spaced away from the end edge, so that the portion 22 provides a tab or tongue to be gripped by the fingers.

A series of such label/leaflet assemblies are disposed end to end on the web 10 and can be stored in the form of a reel until required for application to the products they are to identify. Application of the assemblies is conveniently carried out by automatic means in the well-known way, the web being passed round a roller of small diameter disposed at a station past which the products are fed in succession. The roller causes the label/leaflet assemblies to separate from the web and to become attached by the adhesive 11*a* to the products as the products pass the station.

Subsequently, in use by the purchaser, the tab is pulled upward the cover sheet tears along the lines 20 to the slits 18 to give access to the leaflet. Subsequently the tab can be releasably re-attached to the label sheet by the line of adhesive 23 so as to re-seal the leaflet. The tearing along the lines 20 however provides a visual indication that the leaflet has been opened, which is desirable where the leaflet contains an offer or other content of monetary value or where there is a risk of the leaflet being tampered with.

The corner areas 21 may be secured to the label sheet by a different adhesive from that used for the line 23, or by the same adhesive if the mating surfaces of the tab 22 are rendered impervious, as by a suitable lacquer or varnish, to penetration by the adhesive used in the corner areas.

In a modified construction the parts of the corner areas 21 adjoining the slits 18 are left free of adhesive and the panels 14 and 16 of the leaflet extend so that their edges can be engaged under these parts of the corner areas prior to re-sealing.

Figure 2:
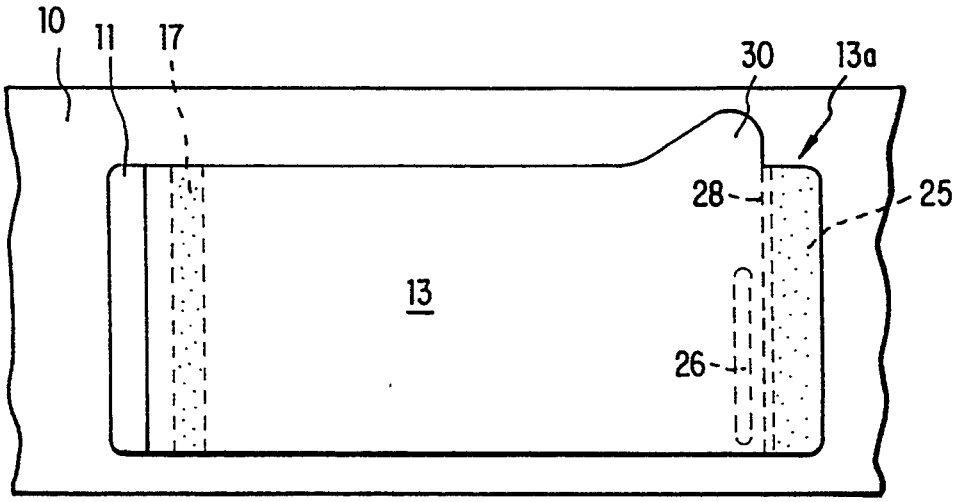
Figure 3:
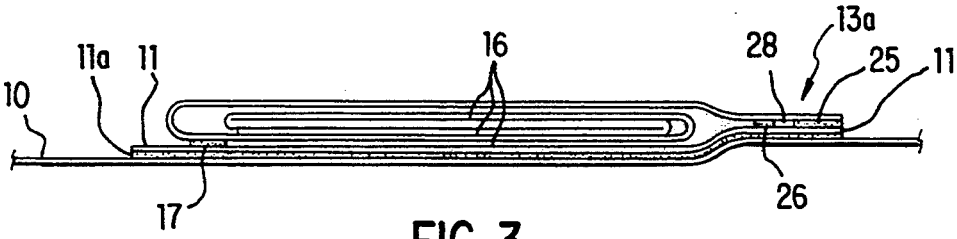

FIGS. 2 and 3 illustrate another form of construction according to the invention. In this construction the end of the label sheet 11 underlying the end portion 13*a* of the cover sheet has a transverse band 25 of adhesive and, spaced away from band 25, a line of adhesive 26 which extends only part way along the transverse dimension of the label sheet. The end portion of the front sheet is secured to the label sheet by the band 25 of adhesive and has a broken line of slits forming a tear line 28 which extends across the end portion between the band 25 and the line of adhesive 26. The end portion has a laterally projecting tab 30 at the side of the tear line nearer the main body of the front cover. The line of adhesive 26 operates to attach the end portion detachably and re-sealably to the label sheet and the adhesive is selected accordingly.

Thus when the tab 30 is pulled away from the web 10 by the purchaser of the product, the front cover tears along the line 28 leaving the edge margin secured to the label sheet, but the cover sheet is released by the line of adhesive 26 to give access to the leaflet, and subsequently the folded leaflet can be releasably re-attached to the label sheet by the line of adhesive 26.

Again, the tearing of the end portion along the tear line 28 gives a visible indication that the label/leaflet has been opened.

Figure 4:
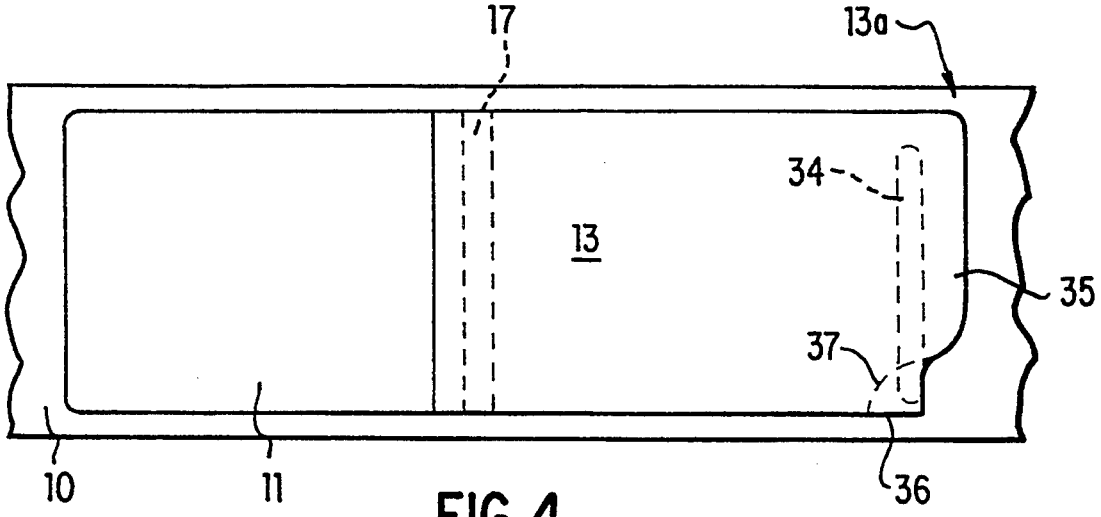
Figure 5:
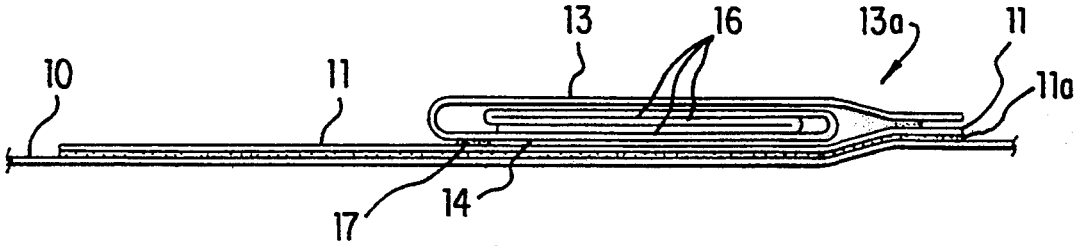

FIGS. 4 and 5 show another form of the end portion 13*a* in accordance with the invention. In this form, the part of the label sheet underlying the end portion 13*a* has a transverse band of adhesive 34 and part of the portion 13*a* extends beyond the adhesive so as to form a tab or flap 35 which can be gripped to tear open the label/leaflet assembly. The tab 35 narrows adjacent the lower edge 36 of the leaflet and the underlying edge of the label sheet is shaped correspondingly. A broken line of slits 37 extends in a curve from the free edge of the end portion 13*a* across the band of adhesive to the bottom edge 36 of the portion 13*a*. Above this line of slits 37, the rear face of the portion 13*a* has a coating of a varnish or lacquer to which the adhesive 34 adheres detachably and re-sealably; but below the line, no varnish or lacquer is used and the adhesive forms a secure bond with the material of the front cover.

To gain access to the leaflet, the tab 35 is grasped and pulled outward to detach the portion 13*a* from the adhesive 34 where the portion is coated with varnish or lacquer, but the part of portion 13*a* below the slits 37 is firmly adhered to the label sheet and in consequence portion 13*a* becomes torn along the line of slits 37. The front cover of the leaflet can subsequently be releasably re-attached to the label sheet by the adhesive 34, but the tearing along the line 37 provides a visual indication that the leaflet has been opened.

The tear line or lines need not be weakened in the various constructions and need not be marked on the leaflet since in some cases they may be quite short and/or such as to be torn without the application of particular force.

The constructions described and illustrated are also advantageous in that they overcome application difficulties associated with currently available re-sealable label/leaflets, which often spring open during application to the produce or during packing of the product, particularly under certain climatic conditions, e.g. of heat or cold. The permanently sealed part of the portion 13*a* and the tear line together hold the leaflet closed, but the leaflet can nevertheless be re-sealed after use.

I claim:

1. A tamper evident label assembly comprising a label sheet, a leaflet and transverse line of adhesive for securing the leaflet to the front face of the label sheet, the leaflet having a front cover sheet with a main body part overlying other sheets of the leaflet and an end portion extending beyond said other sheets, the said end portion of the cover sheet having one or more areas thereof adhesively fixed to the label sheet, the part of the said end portion other than said area or areas being releasably and re-attachably adhesively attached to the label sheet and a tear line or lines which extend at least partially in a direction lengthwise of the leaflet between two or more points, distant from one another, on the edge of the cover sheet and along which tear line or lines said one or more areas are separably connected to the other said parts of the end portion, the arrangement being such that when said end portion is torn along the tear line or lines, said one or more areas remain adhesively secured to the label sheet and the other parts of the end portion remain connected to the main body part of the cover sheet whereby the main body part is resealable to the label sheet by means of said other parts of the end portion.

2. An assembly as claimed in claim 1, wherein an adhesive is applied to the front face of the label sheet for releasably and re-attachably attaching said other part of said end portion to the label sheet and for adhesively fixing said one or more areas to the label sheet, said other part of said end portion having thereon a coating which renders them releasably and re-attachably attached to the label sheet by the adhesive on the front face of the label sheet.

3. An assembly as claimed in claim 1, wherein said one or more areas comprise one or both of two corner parts at opposite transverse ends of said end portion of the cover sheet.

4. An assembly as claimed in claim 3, wherein the two corner parts constitute said areas, and a part of the end portion between said corner parts has an end edge extending beyond said corner parts and unattached to the label sheet so as to provide a tongue or tab capable of being gripped by the fingers.

5. An assembly as claimed in claim 4, wherein said corner part of each of the corner parts is defined by a respective tear line in the form of a slit extending to a lateral edge of the cover sheet from a location adjacent such edge and by a line of slits extending from the inner end of the slit of the end edge of said end portion.

6. An assembly as claimed in claim 1, wherein said end portion comprises a transverse edge margin which is adhesively fixed to the label sheet and a transverse strip which is disposed between said transverse edge margin and said main body and which is connected to said edge margin by a tear line as aforesaid and is releasably and re-attachably adhesively attached to the label sheet.

7. An assembly as claimed in claim 6, wherein one transverse end of said strip extends beyond said edge margin to form a projecting tab.

8. An assembly as claimed in claim 1, wherein said end portion of the front sheet is releasably and re-attachably adhesively attached along one part of its transverse length to the label sheet and along a second part of its transverse length is adhesively fixed to the label sheet, said second part being connected to said one part and said main body along a tear line or respective tear lines as aforesaid.

9. An assembly as claimed in claim 8, wherein a transverse band of adhesive is provided on the part of the label sheet underlying said end portion, said one part of the end portion of the front cover sheet having on its surface facing the line of adhesive a coating which causes said one part to be releasably and reattachably attached to the label sheet by said band of adhesive, said second part of the end portion being fixed to the label sheet by said line of adhesive.

10. An assembly as claimed in claim 1, wherein said tear line or each of said tear lines is formed by a line of slits.

11. A tamper evident label assembly comprising a label sheet, a leaflet and a transverse line of adhesive for securing the leaflet to the front face of the label sheet, the leaflet having a front cover sheet with a main body part overlying other sheets of the leaflet and an end portion extending beyond said other sheets, the said end portion of the cover sheet having one or more areas thereof adhesively fixed to the label sheet, the part of the said end portion other than said area or areas being releasably and re-attachably adhesively attached to the label sheet, and a tear line or lines which extend at least partially in a direction lengthwise of the leaflet between two or more points, distant from one another, on the edge of the cover sheet and along which tear line or lines said one or more areas are separably connected to the other said parts of the end portion, said other part of said end edge portion including a tab which is non-adherent to the label sheet, the arrangement being such that the tab can be gripped and enables the end portion to be torn along the tear line or lines, whereby said one or more areas remain adhesively secured to the label sheet and said other parts of the edge portion remain connected to the main body part of the cover and are resealable to the label sheet.

12. A tamper evident label assembly comprising a label sheet, a leaflet and a transverse line of adhesive for securing the leaflet to the front face of the label sheet, the leaflet having a front cover sheet with a main body part overlying other sheets of the leaflet and an end portion extending beyond said other sheets, the said end portion of the cover sheet having two corner portions at opposite transverse ends thereof adhesively fixed to the label sheet and a part intermediate the two corner portions being releasably and re-attachably adhesively attached to the label sheet, and tear lines which extend at least partially in a direction lengthwise of the leaflet between points, distant from one another, on the edge of the cover sheet and by which tear lines said corner portions are separably connected to only said intermediate part, the arrangement being such that when the end portion is torn along the tear lines, said corner portions are separated from said intermediate part and remain fixed to the label sheet, and said intermediate part and said main body part are resealable to the label sheet.

13. A tamper evident label assembly comprising a label sheet, a leaflet and a transverse line of adhesive for securing the leaflet to the front face of the label sheet, the leaflet having a front cover sheet with a main body part overlying other sheets of the leaflet and an end portion extending beyond said other sheets, the said end portion of the cover sheet having part of its transverse length releasably and re-attachably adhesively attached to the label sheet and having the remainder of its transverse length adhesively fixed to the label sheet, and a tear line or tear lines which extend at least partially in a direction lengthwise of the leaflet between two or more points, distant from one another, on the edge of the cover sheet and along which tear line or lines said part is separably connected to said remainder and to said main body part, the arrangement being such that when said end portion is torn along the tear line or tear lines, said remainder remains adhesively secured to the label sheet which said main body part is resealable to the label sheet by means of said part of the transverse length of the edge portion.

* * * * *